US011421421B1

(12) United States Patent
Chin et al.

(10) Patent No.: US 11,421,421 B1
(45) Date of Patent: Aug. 23, 2022

(54) PORTABLE OVERSPRAY DEVICE

(71) Applicant: BMIC LLC, Dallas, TX (US)

(72) Inventors: Norman M. Chin, Somerville, NJ (US); Daniel E. Boss, Morris Township, NJ (US); Lingtao Yu, Summit, NJ (US); Linlin Xing, Wayne, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/676,997

(22) Filed: Feb. 22, 2022

Related U.S. Application Data

(60) Provisional application No. 63/243,784, filed on Sep. 14, 2021.

(51) Int. Cl.
*E04D 15/06* (2006.01)
*E04D 5/14* (2006.01)

(52) U.S. Cl.
CPC ..... *E04D 15/06* (2013.01); *E04D 5/148* (2013.01)

(58) Field of Classification Search
CPC ..... E04D 15/06; E04D 5/148
USPC ..... 52/746.11; 156/71, 356, 578
See application file for complete search history.

(56) References Cited

U.S. PATENT DOCUMENTS 1,846,145 A * 2/1932 Robinson ..... E04D 15/06 156/575
4,099,682 A * 7/1978 Benuska ..... B65H 19/2207 242/532.6
4,222,212 A * 9/1980 Alderman ..... E04D 15/06 242/598.5
4,331,716 A * 5/1982 Stark ..... B05D 1/32 427/284
4,725,328 A * 2/1988 Arnold ..... B29C 66/1122 156/308.2
4,761,201 A * 8/1988 Nichols, Jr. ..... E04D 15/06 156/499
4,869,044 A * 9/1989 Wald ..... B29C 66/43 156/577
5,056,458 A * 10/1991 Askeland ..... B05B 12/29 220/8
5,213,278 A * 5/1993 Holbek ..... E04D 15/06 242/909
6,024,147 A * 2/2000 Hunter, Jr. ..... E04D 7/00 156/391
6,484,781 B2 * 11/2002 Weaver ..... E04D 15/06 156/577
6,588,475 B1 * 7/2003 Simon, Jr ..... B29C 66/4722 156/499
7,347,244 B2 * 3/2008 Vaillancourt ..... E04D 15/04 156/577

(Continued)

*Primary Examiner* — James M Ference
(74) *Attorney, Agent, or Firm* — Venable LLP

(57) ABSTRACT

This invention, in embodiments, relates to a device and a method of attaching a roofing membrane to a building surface that prevents and/or reduces overspray of adhesive onto a welding seam area. The device includes an insertion mechanism configured to hold a roofing membrane as the roofing membrane is being attached to a building surface via an adhesive, and an extension frame attached to the insertion mechanism, the extension frame including a channel that is configured to support and to hold at least one board, to thereby reduce the adhesive from spraying onto a welding seam area as the roofing membrane is being applied to the building surface.

18 Claims, 5 Drawing Sheets

(56) References Cited

U.S. PATENT DOCUMENTS

| | | | | |
|---|---|---|---|---|
| 7,854,212 | B2 * | 12/2010 | Queiroz | B05B 12/28 118/500 |
| 8,887,782 | B2 * | 11/2014 | Bessette | B29C 63/024 156/499 |
| 9,062,459 | B2 * | 6/2015 | Berkowitz | E04D 5/02 |
| 9,376,818 | B1 * | 6/2016 | Kelly | E04D 15/06 |
| 2007/0071898 | A1 * | 3/2007 | Hollins | B05B 14/00 118/504 |
| 2007/0267310 | A1 * | 11/2007 | Berkowitz | E04D 5/02 206/413 |
| 2008/0005973 | A1 * | 1/2008 | Queiroz | B05B 12/28 52/11 |
| 2010/0071291 | A1 * | 3/2010 | Berkowitz | E04D 5/02 52/749.12 |
| 2015/0151326 | A1 * | 6/2015 | Tatia | B05B 12/28 118/505 |
| 2015/0259925 | A1 * | 9/2015 | Berkowitz | E04D 15/06 52/741.4 |
| 2017/0189925 | A1 * | 7/2017 | O'Brien | B05C 21/005 |
| 2020/0055070 | A1 * | 2/2020 | Masalosalo | B05B 12/32 |

* cited by examiner

PORTABLE OVERSPRAY DEVICE

RELATED APPLICATION

This application claims the priority of U.S. provisional application Ser. No. 63/243,784, entitled "Portable Overspray Device" filed Sep. 14, 2021, which is incorporated herein by reference in its entirety for all purposes.

FIELD OF THE INVENTION

This invention relates to a device and a method of attaching a roofing membrane to a building surface that prevents and/or reduces overspray of adhesive onto a welding seam area. In an embodiment, the device includes an insertion mechanism configured to hold a roofing membrane as the roofing membrane is being attached to a building surface via an adhesive, and an extension frame attached to the insertion mechanism, the extension frame including a channel that is configured to support and to hold at least one board, to thereby reduce the adhesive from spraying onto a welding seam area as the roofing membrane is being applied to the building surface.

BACKGROUND OF THE INVENTION

Typically, during attachment of a roofing membrane to a building surface, at least three workers are needed for attaching the roofing membrane to the building surface via an adhesive. Generally, an adhesive is first sprayed onto a substrate and/or a building surface by a first worker. A second worker holding a board, such as, e.g., a piece of isoboard, cardboard, high-density (HD) board, or plywood, or a piece of tarp is positioned along and walks down a welding seam area, as the first worker sprays the adhesive onto the substrate and/or building surface, in order to protect the welding seam area from overspray of the adhesive. This welding seam area is the portion in which two roofing membranes are welded together to create a welded seam at the edges of the roofing membranes. In order to create an effective welded seam, adhesive should not be sprayed or present on this area. If adhesive is sprayed onto this welding seam area, a cleaning step in the procedure is needed to remove any adhesive that is in or on this area. After application of the adhesive, a third worker begins rolling a roofing membrane onto the adhesive sprayed onto the substrate and/or building surface, in order to attach the roofing membrane to the building surface. This process is thus labor, time, and cost intensive.

There is therefore a need for a device and a method of attaching a roofing membrane to a building surface that prevents and/or reduces overspray of adhesive onto a welding seam area, while minimizing the amount of labor, time, and cost.

SUMMARY OF THE INVENTION

One embodiment of this invention pertains to a device that includes an insertion mechanism configured to hold a roofing membrane as the roofing membrane is being attached to a building surface via an adhesive, with the insertion mechanism including a frame and an insert attached to the frame, the insert being configured to hold the roofing membrane. The device further includes an extension frame attached to the frame of the insertion mechanism, the extension frame including a channel that is configured to support and to hold at least one board, to thereby reduce the adhesive from spraying onto a welding seam area as the roofing membrane is being applied to the building surface.

In one embodiment, the at least one board comprises one or more of (i) a polyisocyanurate board, (ii) cardboard, (iii) plywood, and (iv) a high-density board.

In one embodiment, the roofing membrane comprises a roll of the roofing membrane. In some embodiments, the insert comprises an elongated member that is configured to be inserted into a core of the roll of the roofing membrane. In some embodiments, the elongated member of the insert includes one or more spring members configured to compress and to hold the roll of the roofing membrane.

In one embodiment, the extension frame includes at least one spring that is configured to compress and to hold the at least one board.

In one embodiment, the extension frame includes at least one vertical bar that extends perpendicularly to the extension frame in order to provide wind resistance to the at least one board.

In some embodiments, the extension frame is attached to the frame of the insertion mechanism via a rotatable member.

In one embodiment, the roofing membrane comprises a single-ply roofing membrane.

In one embodiment, the building surface comprises a roofing surface.

Another embodiment of this invention pertains to a method of attaching a roofing membrane to a building surface. The method comprises obtaining a device comprising (a) an insertion mechanism configured to hold a roll of the roofing membrane as the roofing membrane is being applied to the building surface, the insertion mechanism including (i) a frame and (ii) an insert attached to the frame, the insert being configured to hold the roll of the roofing membrane, and (b) an extension frame attached to the frame of the insertion mechanism, the extension frame including a channel that is configured to support and to hold at least one board. The method further comprises positioning the roll of the roofing membrane onto the insertion mechanism of the device, positioning the at least one board into the channel of the extension frame, spraying an adhesive onto the building surface, and applying the roofing membrane to the adhesive on the building surface, wherein the device is configured to move with the roll of the roofing membrane as (i) the adhesive is being sprayed onto the building surface and (ii) the roofing membrane is being applied to the adhesive on the building surface, to thereby reduce adhesive from spraying onto a welding seam area as the roofing membrane is being applied to the adhesive on the building surface.

In one embodiment, the at least one board comprises one or more of (i) a polyisocyanurate board, (ii) cardboard, (iii) plywood, and (iv) a high-density board.

In one embodiment, the insert comprises an elongated member that is inserted into a core of the roll of the roofing membrane, during the positioning of the roll of the roofing membrane onto the insertion mechanism of the device. In some embodiments, the elongated member of the insert includes one or more spring members that compress and hold the roll of the roofing membrane, during the positioning of the roll of the roofing membrane onto the insertion mechanism of the device.

In one embodiment, the extension frame includes at least one spring that compresses and holds the at least one board, during the positioning of the at least one board into the channel of the extension frame.

In one embodiment, the roofing membrane comprises a single-ply roofing membrane.

In one embodiment, the building surface comprises a roofing surface. In some embodiments, the roofing surface includes a substrate.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

One embodiment of this invention pertains to a device that includes an insertion mechanism configured to hold a roofing membrane as the roofing membrane is being attached to a building surface via an adhesive, with the insertion mechanism including a frame and an insert attached to the frame, the insert being configured to hold the roofing membrane.

Figures 1A, 1B:
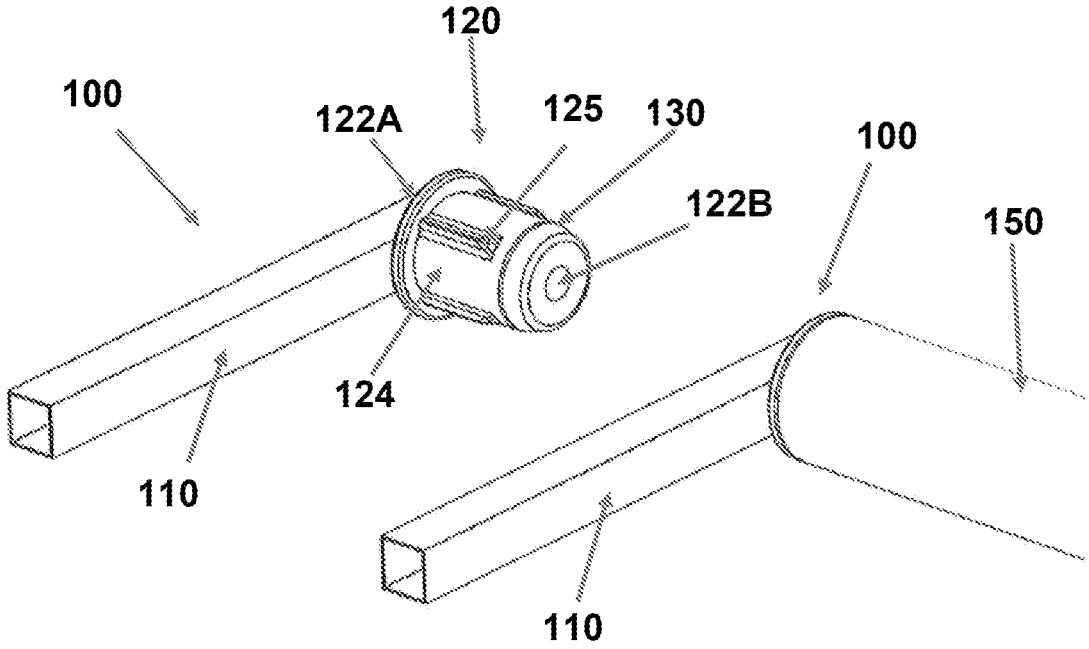
FIGS. 1A and 1B are illustrations of an insertion mechanism according to an embodiment of the invention.

FIGS. 1A and 1B illustrate an embodiment of an insertion mechanism (100). The insertion mechanism (100) includes a frame (110) and an insert (120) attached to the frame (110). The insert (120) comprises an elongated member (130) that includes a first end (122A) adjacent to the frame (110) and a second end (122B) that extends away from the frame (110). The elongated member (130) of the insert (120) further includes a cylindrical surface (124) that extends from the first end (122A) to the second end (122B) of the elongated member (130). Although the elongated member (130) of the insert (120) of the embodiment of FIG. 1A includes a cylindrical surface (124), the surface (124) can be of any shape that allows for the insert (120) to fit within a roll of roofing membrane (150) (see FIG. 1B). The cylindrical surface (124) of the elongated member (130) of the insert (120) further includes one or more protrusions (125) that assist in gripping or holding the roll of roofing membrane (150) onto the insert (120). As shown in the embodiment of FIG. 1B, the insertion mechanism (100) is configured to hold a roofing membrane (150) by inserting or positioning the insert (120) into the hollow core (see, e.g., hollow core 152 of FIG. 2C) of the roofing membrane (150).

Figures 2A, 2B, 2C:
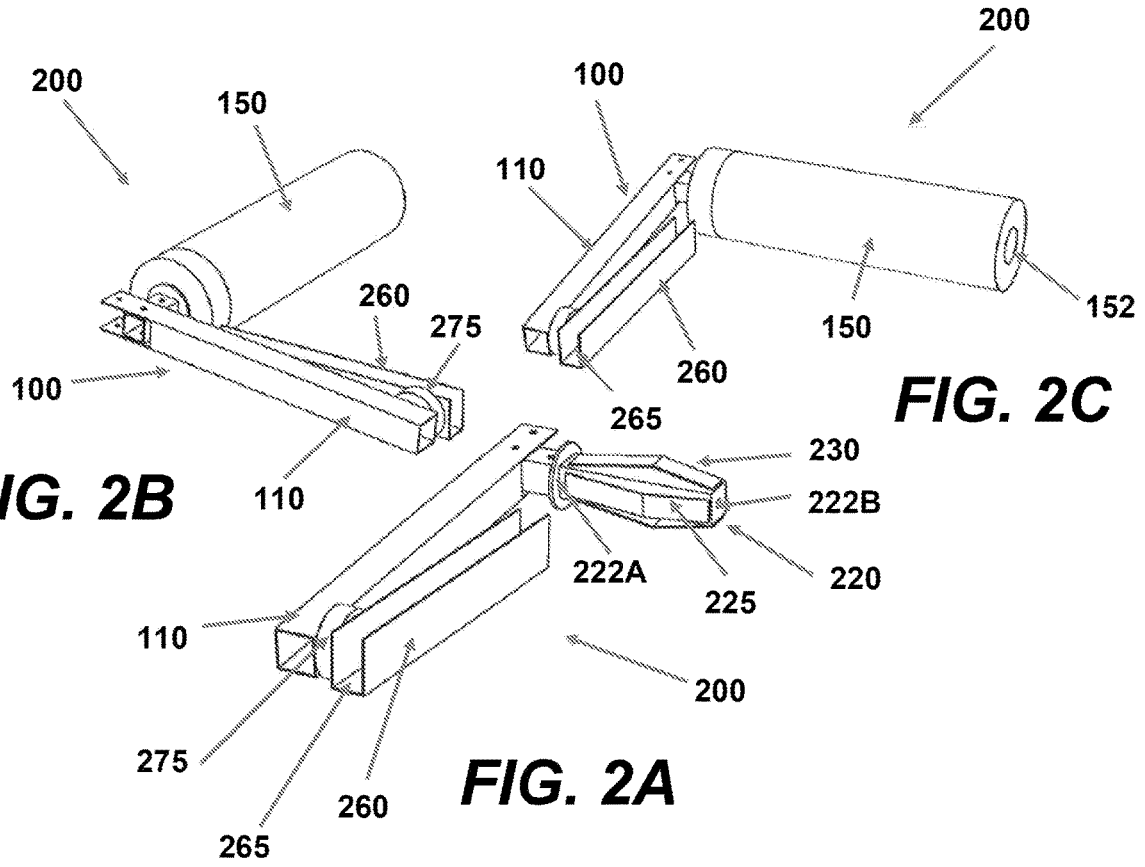
FIGS. 2A-2C are illustrations of an insertion mechanism attached to an extension frame according to an embodiment of the invention.

The device further includes an extension frame attached to the frame of the insertion mechanism, the extension frame including a channel that is configured to support and to hold at least one board, to thereby prevent and/or reduce the adhesive from spraying onto a welding seam area as the roofing membrane is being applied to the building surface. For example, as shown in the embodiment of FIGS. 2A-2C, the device (200) includes an extension frame (260) that is attached to the frame (110) of the insertion mechanism (100) via a rotatable member (275). The extension frame (260) includes a channel (265) that is configured to support and to hold at least one board (see, e.g., board (500) of FIG. 5). As further shown in the embodiment of FIG. 2A, the insert (220) can alternatively comprise an elongated member (230) having one or more spring members (225) that extend from (i) a first end (222A) of the elongated member (230) that is adjacent to the frame (110) to (ii) a second end (222B) of the elongated member (230) that extends away from the frame (110). The one or more spring members (225) assist in gripping or holding the roll of roofing membrane (150) onto the insert (220). As shown in the embodiment of FIG. 2C, the insert (220) is configured to hold a roofing membrane (150) by inserting or positioning the insert (220) into the hollow core (152) of the roofing membrane (150).

Figure 3:
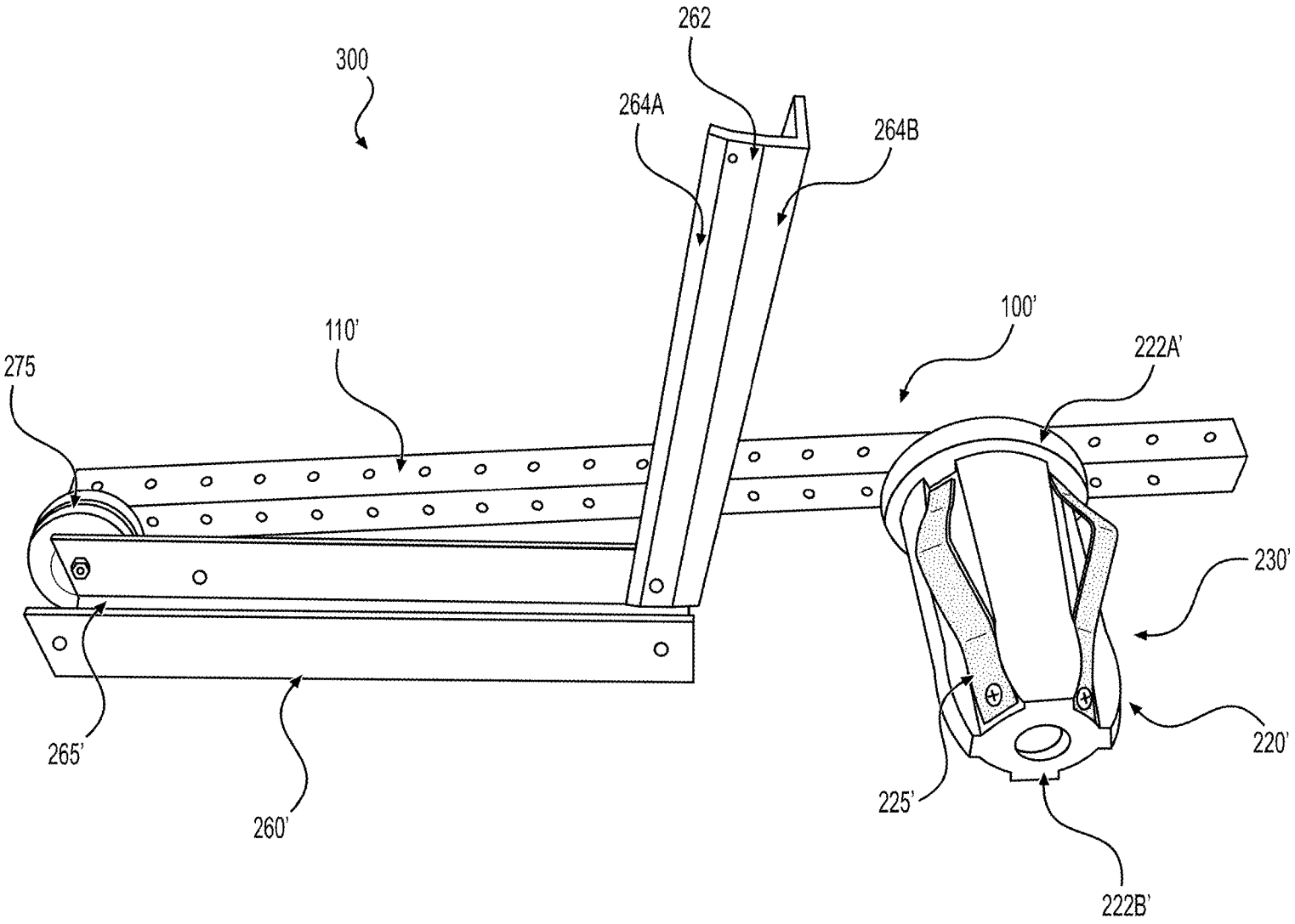
FIG. 3 is an illustration of an insertion mechanism attached to an extension frame according to an embodiment of the invention.

In another embodiment, as shown in FIG. 3, the device (300) includes an insertion mechanism (100') that includes an insert (220') and a frame (110'). The insert (220') of this embodiment is similar to the embodiment of FIG. 2A, with the insert (220') comprising an elongated member (230') having one or more spring members (225') that extend from (i) a first end (222A') of the elongated member (230') that is adjacent to the frame (110') to (ii) a second end (222B') of the elongated member (230') that extends away from the frame (110'). The frame (110') of the insertion mechanism (100') is attached to an extension frame (260') via a rotatable member (275). The extension frame (260') includes a channel (265') that is configured to support and to hold at least one board (see, e.g., board (500) of FIG. 5). Additionally, according to this embodiment, the extension frame (260') is connected to a support member (262) having a first side edge (264A) and a second side edge (264B). The support member (262) provides additional support to the at least one board that is to be positioned within the channel (265') of the extension frame (260') (see, e.g., board (500) of FIG. 5). For example, a board (not shown) can be placed within the channel (265') of the extension frame (260'), with an end of the board (not shown) being positioned against the first side edge (264A) and the second side edge (264B) of the support member (262).

Figure 4:
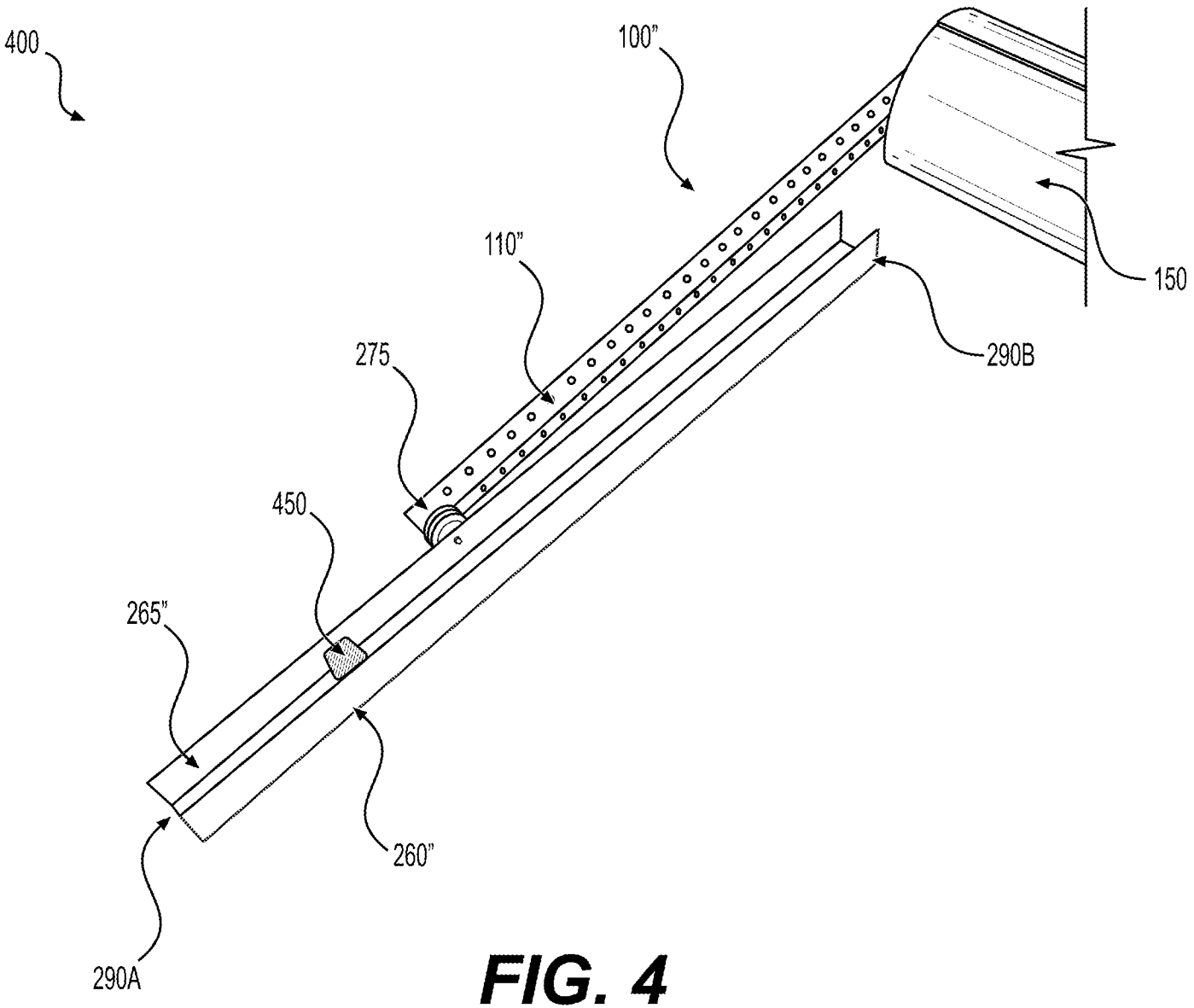
FIG. 4 is an illustration of an insertion mechanism attached to an extension frame according to an embodiment of the invention.

Alternatively, as shown in the embodiment of FIG. 4, the device (400) can include an insertion mechanism (100") that includes an insert (not shown) and a frame (110"). The frame (110") of the insertion mechanism (100") is attached to an extension frame (260") via a rotatable member (275). The extension frame (260") includes a channel (265") that is configured to support and to hold at least one board (see, e.g., board (500) of FIG. 5). According to this embodiment, the extension frame (260") is not connected to a support member (as in the embodiment of FIG. 3), but instead includes a channel (265") that is further extended or elongated as compared to the channel (265') of FIG. 3. As further shown in the embodiment of FIG. 4, the insertion mechanism (100") is configured to hold a roll of roofing membrane (150), with the extension frame (260"), and the channel (265") of the extension frame (260"), extending from a first end (290A) of the extension frame (260") to an second end (290B) of the extension frame (260") that is adjacent to the roll of roofing membrane (150) without contacting the roll of roofing membrane (150). In the embodiment of FIG. 4, the extension frame (260") further includes at least one spring (450) that is configured to compress and to hold the at least one board, and further allows for a self-adjustable channel (265") of the extension frame (260") that is configured to hold a variety of sizes of boards.

In one embodiment, the at least one board comprises one or more of (i) a polyisocyanurate board, (ii) cardboard, (iii) plywood, and (iv) a high-density board In one embodiment, the roofing membrane comprises a roll of the roofing membrane.

In one embodiment, the roofing membrane comprises a single-ply roofing membrane.

In one embodiment, the building surface comprises a roofing surface. In some embodiments, the roofing surface includes a substrate.

Another embodiment of this invention pertains to a method of attaching a roofing membrane to a building surface. The method comprises obtaining a device comprising (a) an insertion mechanism configured to hold a roll of the roofing membrane as the roofing membrane is being applied to the building surface, the insertion mechanism including (i) a frame and (ii) an insert attached to the frame, the insert being configured to hold the roll of the roofing membrane, and (b) an extension frame attached to the frame of the insertion mechanism, the extension frame including a channel that is configured to support and to hold at least one board. The method further comprises positioning the roll of the roofing membrane onto the insertion mechanism of the device, positioning the at least one board into the channel of the extension frame, spraying an adhesive onto the building surface, and applying the roofing membrane to the adhesive on the building surface, wherein the device is configured to move with the roll of the roofing membrane as (i) the adhesive is being sprayed onto the building surface and (ii) the roofing membrane is being applied to the adhesive on the building surface, to thereby prevent and/or reduce adhesive from spraying onto a welding seam area as the roofing membrane is being applied to the adhesive on the building surface.

Figure 5:
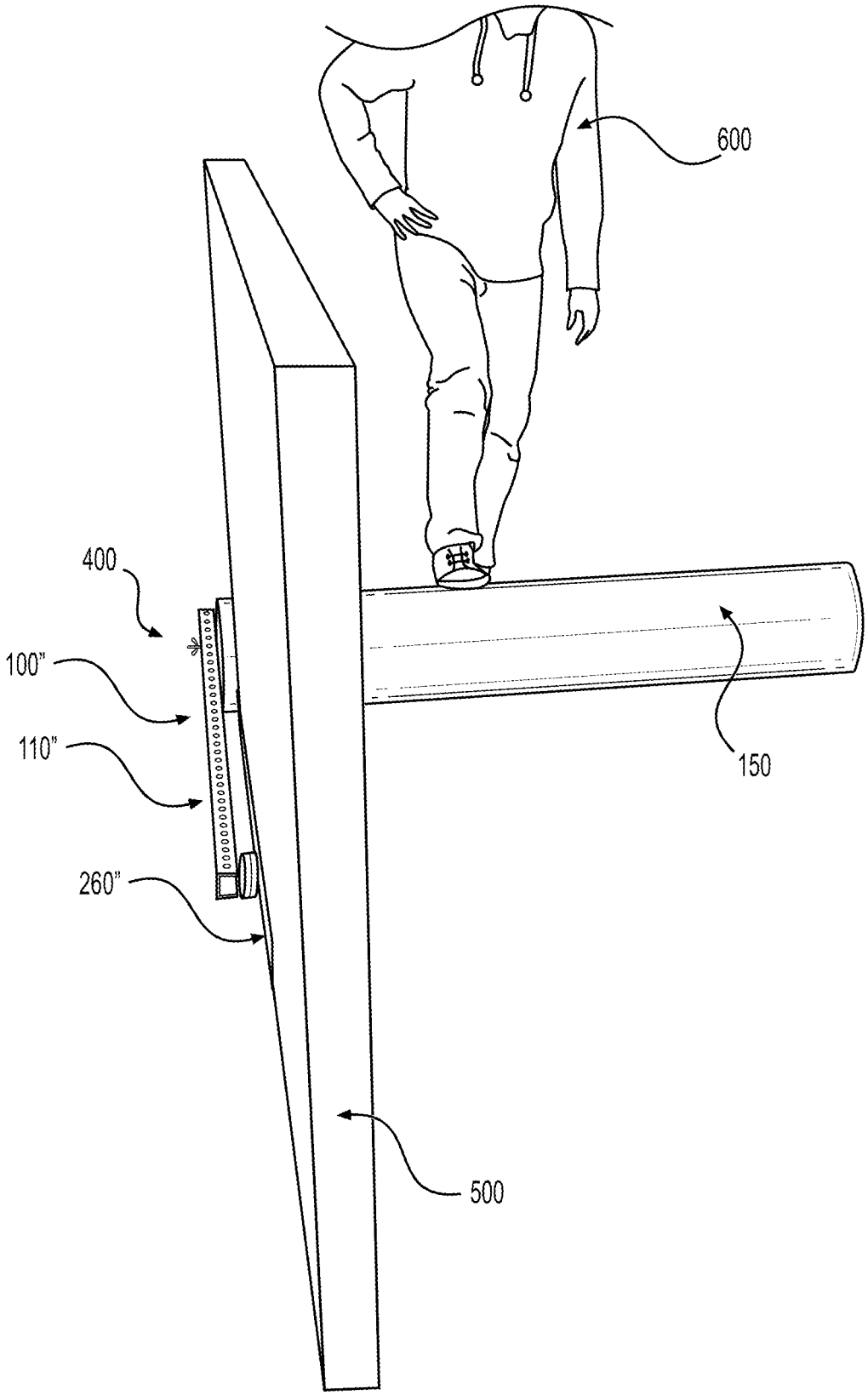
FIG. 5 is an illustration of a device that includes an insertion mechanism holding a roofing membrane and an extension frame supporting and holding a board according to an embodiment of the invention.

For example, as shown in the embodiment of FIG. 5, a device (400) is obtained, with the device (400) comprising (a) an insertion mechanism (100") having an insert (not shown) and a frame (110") and (b) an extension frame (260") attached to the frame (110"). A roll of roofing membrane (150) is positioned onto the insertion mechanism (100") of the device (400). A board (500), such as, e.g., a polyisocyanurate board, is positioned into a channel (not shown) of the extension frame (260"), and the extension frame (260") with the board (500) are further positioned along a welding seam area (not shown) of an adhered roofing membrane (not shown). According to one embodiment, one or more vertical bars (not shown) could be positioned within the extension frame (260"), with the one or more vertical bars extending perpendicularly to the extension frame (260"). These one or more vertical bars would be positioned on one or more sides of the board (500), in order to provide wind resistance and thus, prevent the board (500) from tipping over and/or flying out of the extension frame (260") from a gust of wind striking the board (500).

According to the embodiment of FIG. 5, as one worker (not shown) sprays an adhesive onto a building surface, another worker (600) (or potentially the same worker) can apply the roofing membrane (150) by rolling or pushing the roofing membrane (150) onto the building surface having the adhesive sprayed thereon. The device (400), including the board (500), is configured to move with the roll of roofing membrane (150), and along the welding seam area (not shown), as the roofing membrane (150) is rolled or pushed along by the worker (600) and applied to the building surface. Moreover, by positioning the board (500) within the channel (not shown) of the extension frame (260"), with the extension frame (260") and the board (500) being positioned along a welding seam area (not shown) of the applied roofing membrane, the board (500) prevents and/or reduces adhesive from being sprayed onto the welding seam area, continuously, as the roofing membrane (150) is being applied to the adhesive sprayed onto the building surface. Thus, this configuration allows for two workers to easily work in tandem when applying a roll of roofing membrane to a building surface with (i) a first worker spraying an adhesive to the building surface and (ii) a second worker rolling or pushing the roll of roofing membrane onto the adhesively sprayed building surface with a device (e.g., device (400) of FIG. 5) that assists in holding the roll of roofing membrane, while also continuously preventing and/or reducing overspray of adhesive onto a welding seam area. According to one embodiment, this configuration also allows for one worker to both (i) spray an adhesive to the building surface and (ii) roll or push the roll of roofing membrane onto the adhesively sprayed building surface with a device (e.g., device (400) of FIG. 5).

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A device comprising:

(a) an insertion mechanism configured to hold a roll of roofing membrane as the roofing membrane is being attached to a building surface via an adhesive, the insertion mechanism including:

(i) a frame; and (ii) an insert attached to the frame, the insert being configured to hold the roll of the roofing membrane; and (b) an extension frame attached to the frame of the insertion mechanism, the extension frame including a channel that is configured to support and to hold at least one board, to thereby reduce the adhesive from spraying onto a welding seam area as the roofing membrane is being applied to the building surface.

2. The device according to claim 1, wherein the at least one board comprises one or more of (i) a polyisocyanurate board, (ii) cardboard, (iii) plywood, and (iv) a high-density board.

3. The device according to claim 1, wherein the roofing membrane comprises a roll of the roofing membrane.

4. The device according to claim 3, wherein the insert comprises an elongated member that is configured to be inserted into a core of the roll of the roofing membrane.

5. The device according to claim 4, wherein the elongated member of the insert includes one or more spring members configured to compress and to hold the roll of the roofing membrane.

6. The device according to claim 1, wherein the extension frame includes at least one spring that is configured to compress and to hold the at least one board.

7. The device according to claim 1, wherein the extension frame includes at least one vertical bar that extends perpendicularly to the extension frame in order to provide wind resistance to the at least one board.

8. The device according to claim 1, wherein the extension frame is attached to the frame of the insertion mechanism via a rotatable member.

9. The device according to claim 1, wherein the roofing membrane comprises a single-ply roofing membrane.

10. The device according to claim 1, wherein the building surface comprises a roofing surface.

11. A method of attaching a roofing membrane to a building surface, the method comprising:

(A) obtaining a device comprising:

(a) an insertion mechanism configured to hold a roll of the roofing membrane as the roofing membrane is being applied to the building surface, the insertion mechanism including:

(i) a frame; and (ii) an insert attached to the frame, the insert being configured to hold the roll of the roofing membrane; and (b) an extension frame attached to the frame of the insertion mechanism, the extension frame including a channel that is configured to support and to hold at least one board;

(B) positioning the roll of the roofing membrane onto the insertion mechanism of the device;

(C) positioning the at least one board into the channel of the extension frame;

(D) spraying an adhesive onto the building surface; and (E) applying the roofing membrane to the adhesive on the building surface, wherein the device is configured to move with the roll of the roofing membrane as (i) the adhesive is being sprayed onto the building surface and (ii) the roofing membrane is being applied to the adhesive on the building surface, to thereby reduce any adhesive from spraying onto a welding seam area as the roofing membrane is being applied to the adhesive on the building surface.

12. The method according to claim 11, wherein the at least one board comprises one or more of (i) a polyisocyanurate board, (ii) cardboard, (iii) plywood, and (iv) a high-density board.

13. The method according to claim 11, wherein the insert comprises an elongated member that is inserted into a core of the roll of the roofing membrane, during the positioning of the roll of the roofing membrane onto the insertion mechanism of the device.

14. The method according to claim 13, wherein the elongated member of the insert includes one or more spring members that compress and hold the roll of the roofing membrane, during the positioning of the roll of the roofing membrane onto the insertion mechanism of the device.

15. The method according to claim 11, wherein the extension frame includes at least one spring that compresses and holds the at least one board, during the positioning of the at least one board into the channel of the extension frame.

16. The method according to claim 11, wherein the roofing membrane comprises a single-ply roofing membrane.

17. The method according to claim 11, wherein the building surface comprises a roofing surface.

18. The method according to claim 17, wherein the roofing surface includes a substrate.

* * * * *